US007809316B2

(12) United States Patent
Van Sas et al.

(10) Patent No.: US 7,809,316 B2
(45) Date of Patent: Oct. 5, 2010

(54) TRANSFER APPARATUS FOR TRANSFERRING AN IMAGE OF A DEVELOPER IN A PRINTER AND METHOD FOR CALIBRATING THE HEATING SYSTEM THEREOF

(75) Inventors: Lambertus M. L. Van Sas, Helmond (NL); Fransiscus M. J. Linssen, Riel (NL)

(73) Assignee: Oce-Technologies B.V, Venlo (NL)

( * ) Notice: Subject to any disclaimer, the term of this patent is extended or adjusted under 35 U.S.C. 154(b) by 359 days.

(21) Appl. No.: 11/783,077

(22) Filed: Apr. 5, 2007

(65) Prior Publication Data

US 2007/0242951 A1 Oct. 18, 2007

(30) Foreign Application Priority Data

Apr. 6, 2006 (EP) ..... 06112324

(51) Int. Cl.
*G03G 15/16* (2006.01)

(52) U.S. Cl. ..... 399/307; 399/302; 399/336; 219/216

(58) Field of Classification Search ..... 399/336, 399/307

See application file for complete search history.

(56) References Cited

U.S. PATENT DOCUMENTS 4,001,544 A * 1/1977 Heinzer et al. ..... 219/216
5,633,703 A * 5/1997 Takenouchi et al. ..... 399/315
5,742,889 A 4/1998 Tazelaar et al.
6,356,731 B1 * 3/2002 Shinjo ..... 399/297
6,684,050 B2 * 1/2004 Kiuchi ..... 399/328
6,834,167 B2 * 12/2004 Tomizawa et al. ..... 399/44
2003/0123893 A1 * 7/2003 Fukano et al. ..... 399/69
2004/0175208 A1 * 9/2004 Ichida et al. ..... 399/302
2004/0258426 A1 * 12/2004 Kishi et al. ..... 399/69
2004/0264991 A1 * 12/2004 Yoshikawa ..... 399/69
2005/0205557 A1 9/2005 Sone et al.

FOREIGN PATENT DOCUMENTS

JP 5-216357 A 8/1993
JP 11-249491 A 9/1999
JP 2002-149003 A 5/2002

* cited by examiner

*Primary Examiner*—David M Gray
*Assistant Examiner*—Roy Yi
(74) *Attorney, Agent, or Firm*—Birch, Stewart, Kolasch & Birch, LLP

(57) ABSTRACT

A transfer apparatus for transferring an image of a developer from an image-bearing medium onto an image receiving medium in a transfer zone includes a heating device that heats the image-bearing medium, an adjustable power supply device that supplies electrical power to the heating device, a first temperature sensor for sensing a basis temperature in the vicinity of the image-bearing medium away from the transfer zone and for transmitting to a controller a signal indicative of the basis temperature. The controller is adapted to adjust the power supplied by the power supply device to the heating device to obtain a target temperature in the transfer zone, in response to the signal indicative of the sensed basis temperature and based on a pre-established relationship between the power supplied to the heating device and a temperature difference between a temperature in the transfer zone and the basis temperature.

21 Claims, 7 Drawing Sheets

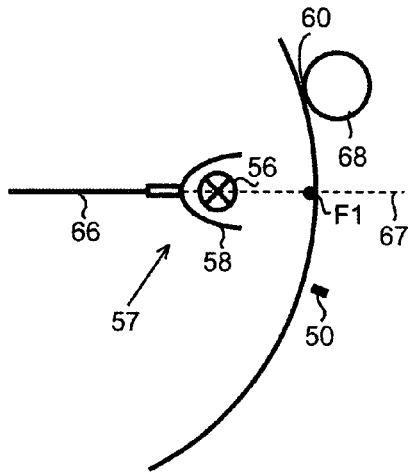
FIG. 5A
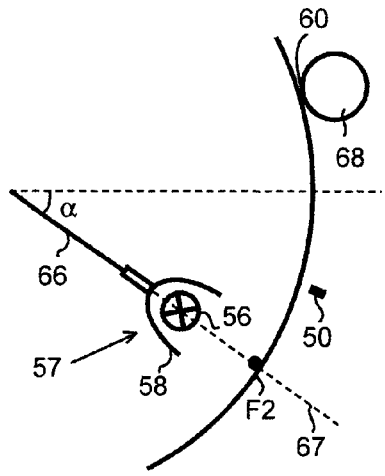
FIG. 5B
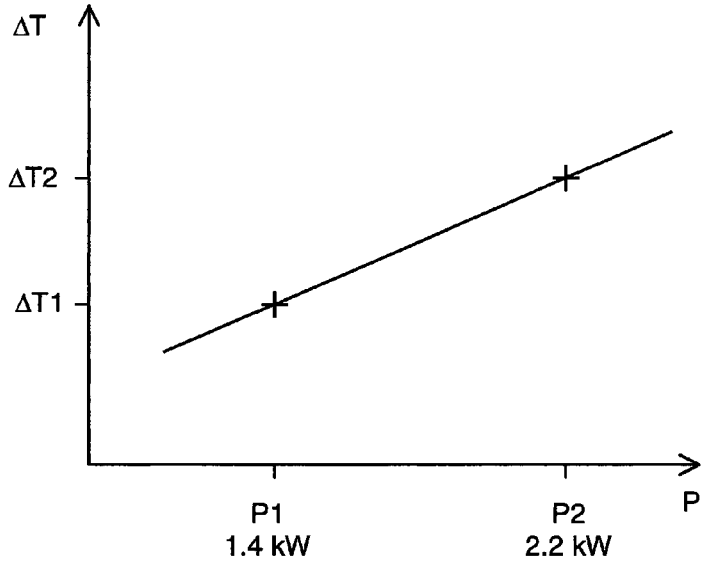
FIG. 7
| P (W) | ΔT (°) |
|---|---|
| 1400 | 24 |
| 1500 | 26.25 |
| 1600 | 28,5 |
| ⋮ | ⋮ |
| 2000 | 37.5 |
| 2100 | 39.75 |
| 2200 | 42 |
80
FIG. 8

TRANSFER APPARATUS FOR TRANSFERRING AN IMAGE OF A DEVELOPER IN A PRINTER AND METHOD FOR CALIBRATING THE HEATING SYSTEM THEREOF

CROSS-REFERENCE TO RELATED APPLICATIONS

This nonprovisional application claims priority under 35 U.S.C. §119(a) on Patent Application No. 06112324, filed in Europe on Apr. 6, 2006, the entirety of which is incorporated herein by reference.

BACKGROUND OF THE INVENTION

1. Field of the Invention

The present invention relates to a transfer apparatus for transferring an image of a developer from an image-bearing medium onto an image-receiving medium. The transfer apparatus includes a pressure member that presses the image receiving medium against the image-bearing medium in a transfer zone, a heating device that heats the image-bearing medium, an adjustable power supply device that supplies electrical power to the heating device, and a first temperature sensor that senses a basis temperature in the vicinity of the image-bearing medium away from the transfer zone and transmits a signal indicative of the basis temperature to a controller.

2. Description of Background Art

A transfer apparatus of the type set forth above is known from the print system Océ CPS700 and is explained in more detailed in the description of the present application, with reference to FIG. 2. The known transfer apparatus has the disadvantage that the quality of the transfer step decreases as the number of print cycles performed with the image-bearing medium increases.

SUMMARY OF THE INVENTION

An object of the present invention is to improve the known transfer apparatus such that the quality of the transfer step roughly remains constant over the entire life of the image-bearing medium.

This object is achieved by the controller being adapted to adjust the power supplied by the power supply device to the heating device to obtain a target temperature in the transfer zone, in response to the signal indicative of the sensed basis temperature and based on a pre-established relationship between the power supplied to the heating device and a temperature difference between a temperature in the transfer zone and the basis temperature.

The ability to obtain a target temperature in the transfer zone ensures that the quality of the transfer step is improved over the entire life of the image-bearing medium. Indeed, after a large number of print cycles, the thickness of the image-bearing medium decreases, due to wear. This fact renders the control of the temperature in the transfer zone particularly important. A target temperature in the transfer zone is attainable, in response to the signal indicative of the sensed basis temperature and based on a pre-established relationship between the power supplied to the heating device and a temperature difference between a temperature in the transfer zone and the basis temperature. The value of the target temperature in the transfer zone is known beforehand and is a temperature that leads to optimum results of the transfer step. The presence of the pressure member renders the placement of a temperature sensor in the transfer zone for measuring the temperature in the transfer zone during printing operation for straightforward feed-back control impracticable. With the signal indicative of the sensed basis temperature and the pre-established relationship between the power supplied to the heating device and a temperature difference between a temperature in the transfer zone and the basis temperature, the controller is able to determine a target temperature difference between the target temperature in the transfer zone and the basis temperature. Based on said determined target temperature difference, and in response to the signal indicative of the sensed basis temperature, the power supplied to the heating device is adjustable to obtain the target temperature in the transfer zone.

According to an embodiment of the present invention, the heating device is provided with a displacing device that moves the heating device from a first position to a second position, the first and second positions being suited for establishing the relationship between the power supplied to the heating device and the temperature difference between the transfer temperature in the transfer zone and the basis temperature. The displacement of the heating device renders possible the determination of the temperature in the transfer zone, since in the second position, the presence of the pressure member does not hinder the determination of the temperature in the transfer zone anymore.

According to another embodiment of the present invention, a second temperature sensor is provided for sensing an auxiliary temperature in the vicinity of the image-bearing medium away from the transfer zone and for transmitting to the controller a signal indicative of the auxiliary temperature, the signal indicative of the basis temperature and the signal indicative of the auxiliary temperature being suited for establishing the relationship between the power supplied to the heating device and the temperature difference between the transfer temperature in the transfer zone and the basis temperature.

According to yet another embodiment of the present invention, the heating device is provided with a displacing device that moves the heating device from a first position to a second position, the first position being the position of the heating device in printing conditions, the second position of the heating device being suited for determining the temperature difference between a temperature in the transfer zone and the basis temperature as being equal to the difference between the sensed auxiliary temperature and the sensed basis temperature.

The present invention also relates to a method for calibrating a heating system of a transfer apparatus for transferring an image of a developer from an image-bearing medium onto an image receiving medium in a transfer zone, said heating system comprising a heating device that heats the image-bearing medium and an adjustable power supply device that supplies electrical power to the heating device.

The method according to an embodiment of the present invention comprises the steps of supplying power to the heating device according to a first power value, determining a first temperature difference between a temperature of the image-bearing medium in the transfer zone and a temperature of the image-bearing medium away from the transfer zone at said first power value, supplying electrical power to the heating device according to a second power value, determining a second temperature difference between a temperature of the image-bearing medium in the transfer zone and a temperature of the image-bearing medium away from the transfer zone at said second power value and establishing a relationship between a value of the power supplied to the heating device and a temperature difference between a temperature in the transfer zone and a temperature of the image-bearing medium away from the transfer zone at said value of the power supplied.

With the steps of the method of calibrating a heating system of a transfer apparatus, the relationship between the power supplied to the heating device and a temperature difference between a temperature in the transfer zone and the basis temperature can be accurately established. Calibration of the heating system of a transfer apparatus is required after a given number of print cycles, in order to take into account the changes due to the changing of the image-bearing medium properties.

Printing techniques in which an image of a developer such as toner powder is firstly transferred from an image-forming element to an intermediate image-bearing medium and in which said image is then transferred by means of a transfer apparatus, under pressure and possibly combined with a supply of heat, to an image receiving medium such as a sheet of paper are known in various forms. U.S. Pat. No. 5,742,889 discloses an example of a transfer apparatus used in a printing apparatus based on electrophotography.

The transfer apparatus of the present invention may be used in any printing apparatus employing an imaging process working in combination with an intermediate image-bearing medium. Examples of such imaging processes are magnetography, electro(photo)graphy, direct induction printing techniques or the like. Other imaging processes in which an intermediate image-bearing medium may be used are processes in which liquid ink or melted ink (hot melt ink) is directly deposited by means of an ink jet printhead to form an image on the top surface of the intermediate image-bearing medium. The image is then transferred by means of the transfer apparatus to the image receiving medium such as a sheet of paper.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 5A and 5B show, respectively, the heating device in a first and second position;

FIG. 7 is a graphical representation of the temperature difference as a function of the power supplied to the heating device;

FIG. 8 is an example of a look-up table;

DETAILED DESCRIPTION OF THE PREFERRED EMBODIMENTS

Figure 1:
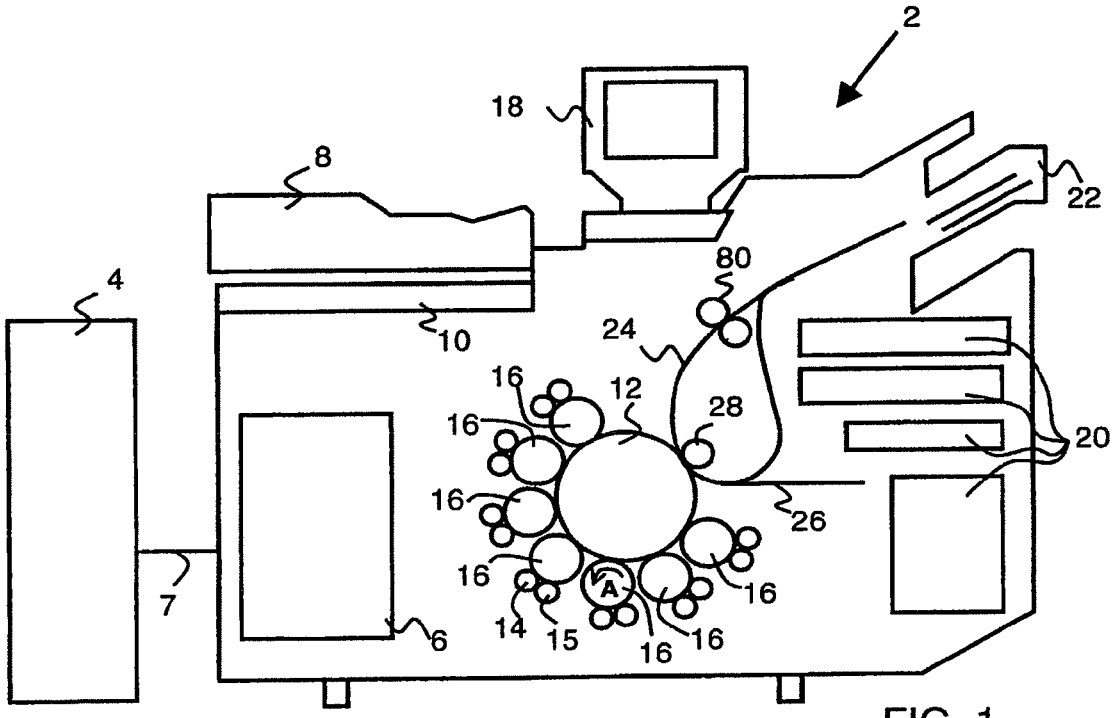
FIG. 1 diagrammatically illustrates a printing apparatus using a direct induction printing technique.

FIG. 1 is a schematic diagram of a cross section of a printing apparatus using a direct induction printing technique. A print engine 2 is connected to a print server 4 through a connection cable 7. The print server 4 is suited for receiving print jobs from client computers (not shown) and converting them in a format that can be processed by the print engine 2. It ensures, in co-operation with an image processing unit 6 placed inside the print engine 2, that the digital images are printed on an image receiving medium such as sheets of paper.

The printing apparatus includes a user interface panel 18, provided with a display screen and a key panel. The user interface panel 18 is connected to the image processing unit 6 and to the print server 4 and is suited for selecting a user, setting queuing parameters, changing print job attributes, etc.

The print engine includes a number of image-forming elements 16. Each image-forming element includes a rotating drum that can be driven in the direction of the arrow A by a suitable driving device (not shown). For printing color images, a plurality of image-forming elements 16 is used, each of said elements being supplied with toner in a specific color like cyan, magenta, yellow, red, blue, green or black for forming a separation image. Each image-forming element 16 is provided with a number of energizable image-forming electrodes placed beneath a dielectric layer. A magnetic roll 14 and a developing unit 15 are also provided. Conductive and magnetically attractive toner powder is supplied to the magnetic roll 14. By applying a predefined bias voltage to the magnetic roll 14 including a number of magnets, a uniform layer of toner powder is applied to the outer surface of the image forming element 16. The electrodes placed on the outer circumferential surface of the image-forming element 16 are activated image-wise by means of drivers placed on an electronic control unit. According to the image line to be printed, the ring electrodes retain an activation pattern, i.e. an electrical potential pattern in accordance with image information supplied by the image processing unit A soft-iron knife is disposed inside of the developing unit 15 and is placed between two magnets for generating a magnetic field in a gap. In an image-forming zone defined by the magnetic field in the gap, the toner powder is selectively removed from the surface of the image-forming element 16 by the developing unit 15, depending on the activation pattern on the ring electrodes.

A toner powder image, being a separation image, is thus formed on the surface of each image-forming element 16. Each separation image is then transferred successively by means of pressure contact with an intermediate image-bearing medium, being for example a rubber surface forming the top surface of a transfer drum 12. The complete color image is thus formed on said rubber surface and can be transferred and fused onto an image receiving medium (for example a sheet of paper) by a transfer apparatus to be described in more detail hereinafter. The sheet of paper is conveyed from any of the paper trays 20 to the transfer drum by the guide track 26 and is then pressed between the transfer drum 12 and the pressure roll 28 of the transfer apparatus. The sheet of paper may then be conveyed by the guide track 24 to the post fuser unit 80 and can undergo a duplex loop for printing on the reverse side, or can be directly output in the receiving tray 22.

Figure 2:
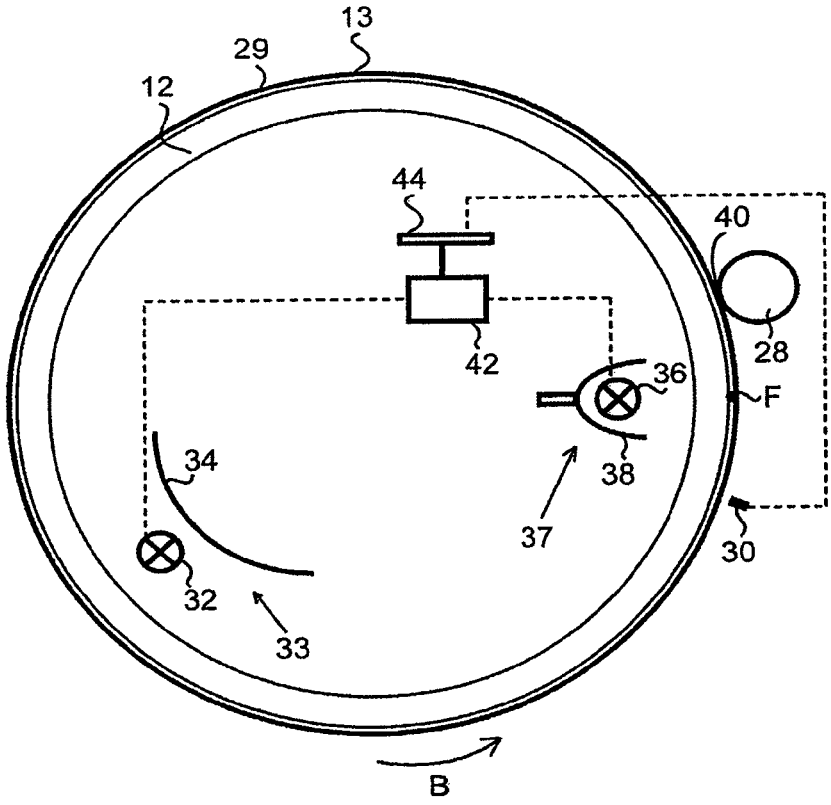
FIG. 2 Background Art
FIG. 2 diagrammatically illustrates a cross section of a transfer apparatus of the background art.

FIG. 2 is a schematic diagram of a known transfer apparatus that may be used in a printing apparatus using a direct induction printing technique. The transfer apparatus of the background art functions in co-operation with the rotatable transfer drum 12, which is covered by an elastic image-bearing medium 13. In operation, the transfer drum 12 is rotated by a driving device (not shown) in the direction of the arrow B. The known transfer apparatus includes a pressure roll 28, a heating device 33 and 37, an electrical power supply device 42, a controller 44 that controls the power supply device 42 and a temperature sensor 30 that measures a temperature in a vicinity of the image-bearing medium 13. The pressure roller 28 is adapted to press an image receiving medium against the image-bearing medium 13 in a transfer zone or nip 40. The heating device 33 and 37 are provided in the hollow interior portion of the transfer drum for heating the image-bearing medium 13 from the inside outwards. Preferably, the transfer drum 12 is transparent or practically transparent, which is the case with a transfer drum made of glass, for example. The transfer drum's wall may be about 4 mm thick. A transparent rubber layer 29 may be provided between the transfer drum 12 and the image-bearing medium 13. Preferably, the transparent rubber layer 29 is a silicon rubber and may be about 2 mm thick. The image-bearing medium 13 is preferably an opaque silicon rubber with a thickness of about 0.1 mm, for example. Since the drum 12 and the layer 29 are transparent, while the image-bearing medium 13 is opaque and relatively thin, the latest can thus be efficiently heated from the inside outwards by the heating device 33 and 37. The heating device 33 includes a radiant heater 32 and an infra-red reflector 34. The heating device 37 includes a radiant heater 36 and an infra-red reflector 38. The infra-red reflectors 34 and 38 are provided in order to reflect the heat generated by the radiant heaters 32 and 36, respectively, towards the inner surface of the transfer drum 12. The convergent reflector 38 is adapted to concentrate the heat (i.e. the infra-red radiation) generated by the radiant heater 36 towards a focus area F located at the inner surface of the image-bearing medium 13. The divergent reflector 34 is adapted to disperse the infra-red radiation emitted by the radiant heater 32 towards the rubber layer 13 over a wide radius. The temperature sensor 30, placed in the vicinity of the rubber layer outer surface 13, is connected to the controller 44 in order to provide a measured temperature signal used by said controller to control the power outputted by the power supply device 42. The temperature sensor 30 is placed such that the measured temperature is approximately the temperature of the outer surface of the rubber layer 13.

During a printing operation, the image-bearing medium 13 has to be heated such that a temperature above the softening temperature of the toner powder is obtained in the transfer and fuse nip 40. When the known apparatus is in a printing operation, a first control signal, representing an instruction, is transmitted by the controller 44 to the power supply device 42. It ensures that the power supply device outputs a constant electrical power, for example having the value 1100 W, to the heating device 37 via a first outlet. The value of the constant electrical power is pre-determined and is not modified during the lifetime of the image-bearing medium 13. As a consequence, infra-red radiation having a constant intensity is emitted from the radiant heater 36, the emitted radiation being reflected and focussed by the reflector device 38 towards the focus area F located on the inner surface of the rubber layer 13. During a printing operation, the transfer drum 12, together with the rubber layers 29 and 13 placed thereon, is rotated in the direction of the arrow B. Since the focus area F is located in the vicinity of and upstream from the nip 40 (with respect to the rotation direction B), the generated heat is effectively diffused in the nip 40 wherein the transfer and fuse steps take place, under the influence of pressure and heat.

During a printing operation, the temperature sensor 30 transmits at regular intervals a temperature signal to the controller 44, the temperature signal representing a measured temperature $T_{BASIS}$ in the vicinity of the rubber layer 13, upstream from the focus area F, when considering the rotation direction B of the transfer drum 12. On the basis of the transmitted temperature signal, the controller 44 transmits a second control signal representing an instruction to the supply device 42. It ensures that the power supply device 42 outputs an adjustable electrical power P to the heating device 33 via a second outlet. The adjustable electrical power is adjusted in such a way that the temperature $T_{BASIS}$ measured by the temperature sensor 30 remains substantially constant (for example, the target value for $T_{BASIS}$ could be 76 degrees Celsius). The temperature signal thus provides a feed-back signal to the controller 44 for continuously ensuring that the measured temperature $T_{BASIS}$ in the vicinity of the rubber layer 13, upstream from the focus area F, is kept substantially constant, i.e. within certain tolerances.

In summary, the transfer apparatus of the background art thus includes a heating device 33 and 37 supplied by an electrical supply device 42 for heating the image-bearing medium 13 from the inside outwards, and a temperature sensor 30 for measuring a temperature ($T_{BASIS}$) in a vicinity of the image-bearing medium 13 and adapted for transmitting a temperature signal to the controller 44. During a printing operation, the heating device 37 is supplied by the electrical supply device 42 with a constant power. In operation, the controller 44 determines the setting value P for the adjustable power to be supplied by the supply device 42 to the heating device 33 based on the measured temperature $T_{BASIS}$ ensuring that $T_{BASIS}$ remains substantially constant.

It is noted that, in the embodiment shown in FIG. 2, considering the rotation direction of the transfer drum 13 indicated by the arrow B, the sensor 30 is positioned upstream from the focus area F, being itself positioned upstream from the nip 40. Compared to the circumference of the transfer drum (about 935 mm), the sensor 30, the focus area F and the nip 40 are positioned closely to each other, the distance between the sensor 30 and the focus area F and the distance between the focus area F and the nip 40 being approximately 25 mm, for example. The heating device 37 is placed upstream from the nip 40 in such a way that, during a printing operation, the generated heat that is focused towards the area F then diffuses through the rubber layer 13 during the time interval needed for the transport performed by the rotating transfer drum 12 until the nip 40 is reached. The transport takes a short period, during which the generated heat diffuses from the inner of the rubber layer 13 towards the outer surface of the rubber layer 13, such that reaching the maximum temperature of the outer surface of the rubber layer 13 takes place in the nip 40.

Ideally, given the fact that the measured temperature $T_{BASIS}$ is kept substantially constant by means of the provided feed-back control, while the power supplied to the heating device 37 is constant during a printing operation, the temperature $T_{NIP}$ reached in the nip 40 should be substantially constant. Indeed, since the value of the power used to drive the heating device 37 is constant during a printing operation, the thermal energy transmitted by the radiant heater 36 to the rubber layer 13 should be constant. Ideally, the constant thermal energy should induce a constant temperature jump $\Delta T_J$ being the difference between the measured temperature $T_{BASIS}$ and the temperature $T_{NIP}$ ($\Delta T_J = T_{NIP} - T_{BASIS}$). Consequently, during a printing operation, the temperature $T_{NIP}$ in the nip 40 should be constant. However, it is observed that the quality of the transfer/fuse step deteriorates after a large number of printing cycles. This is attributed to an uncontrolled modification of the temperature jump $\Delta T_J$ (and consequently of the temperature in the nip) over the lifetime of the image-bearing medium 13. During the lifetime of the image-bearing member, the latter becomes thinner due to wear. With the apparatus known from the background art, the temperature in the nip tends to increase in an uncontrolled fashion, since the power supplied to the heating device 37 is constant, while the basis temperature is also kept constant by means of the feed-back control for adjusting the power supplied to the heating device 33.

Figure 6:
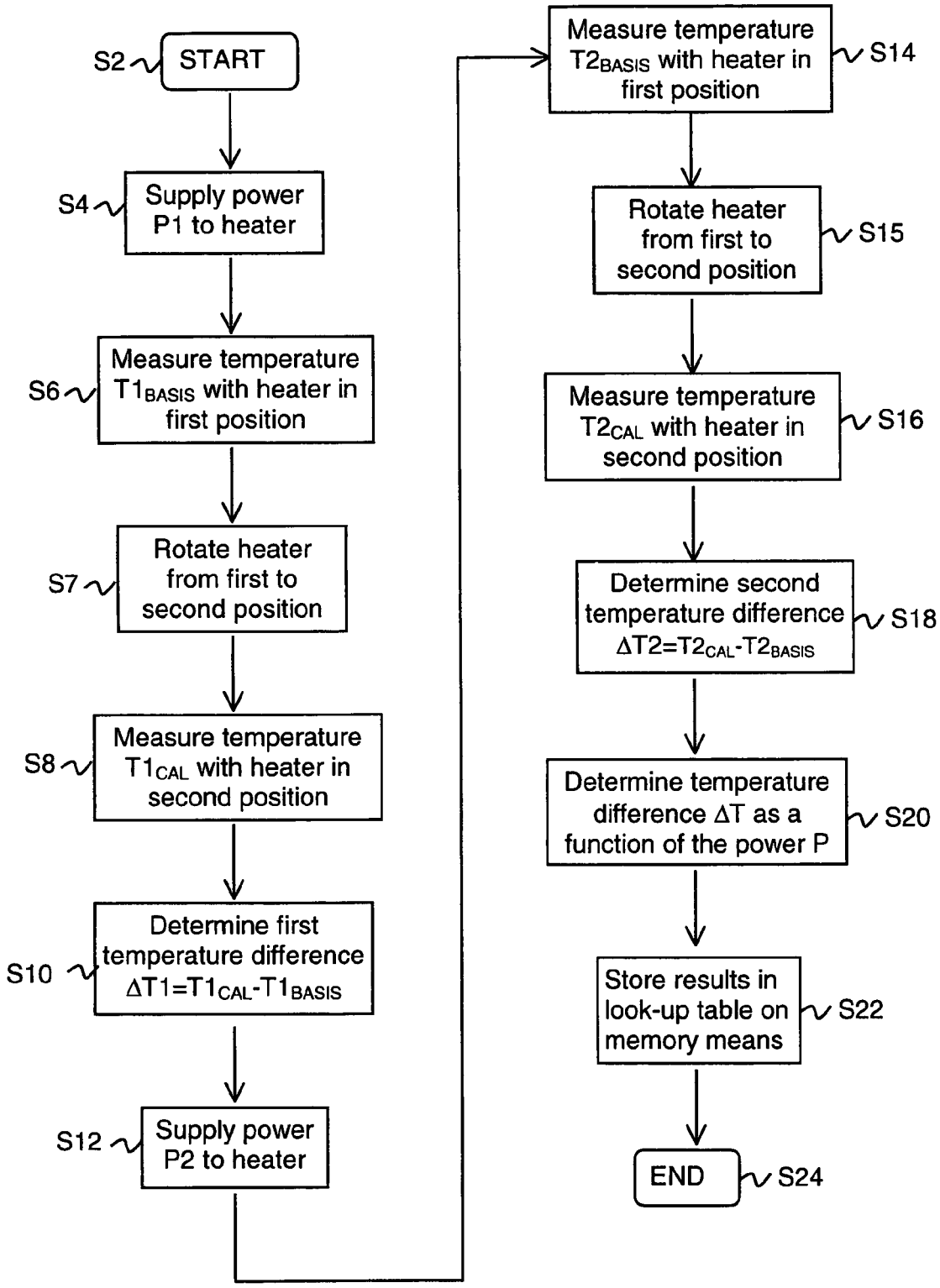
FIG. 6 is a flow-chart diagram illustrating the calibration method according to a first embodiment of the present invention.

The transfer apparatus according to a first embodiment of the present invention is represented schematically in FIGS. 3, 4, 5A and 5B and is explained in conjunction with the flowchart of FIG. 6, representing the calibration method according to a first embodiment of the present invention. The transfer apparatus may be used in a printing apparatus employing a direct induction printing technique or any other printing technique wherein transfer from an image-bearing medium to a receiving medium is required, such as electrophotographic printers, inkjet printers using an intermediate, etc. The transfer apparatus functions in co-operation with a rotatable transfer drum 12 covered by an image-bearing medium 13. The arrow B indicated the rotation direction of the drum 12. The transfer drum's wall may be about 4 mm thick. A transparent rubber layer 29 may be provided between the transfer drum 12 and the image-bearing medium 13. Preferably, the transparent rubber layer is a silicon rubber and is about 2 mm thick, for example. The image-bearing medium 13 is preferably an opaque silicon rubber with a thickness of about 0.1 mm, for example. In the first embodiment, the transfer apparatus includes a pressure member in the form of a pressure roll 68 for pressing the image-bearing medium 13 against the image receiving medium in a transfer zone 60, a displaceable heating device 57, an adjustable power supply device 62 that supplies electrical energy to the heating device 57, a controller 64 that controls the electrical power supply device 62, and a temperature sensor 50 that measures a basis temperature ($T_{BASIS}$) in a vicinity of the image-bearing medium 13. The pressure roller 68 is adapted to exert a pressure on an image receiving medium against the image-bearing medium 13 in a nip 60. The displaceable heating device 57 is provided in the hollow interior portion of the transfer drum for heating the image-bearing medium 13 from the inside outwards. The heating device 57 includes a radiant heater 56, a convergent infra-red reflector 58 and a displacing device 66 suited for moving part of or all of the heating device 57 from a first position to a second position (see hereinafter). The controller 64 preferably controls the movements of the displacing device 66. The temperature sensor 50 is suited for transmitting a signal indicative of the basis temperature ($T_{BASIS}$) to the controller 64. The temperature sensor 50 is placed such that the measured temperature is approximately the temperature of the outer surface of the rubber layer 13.

The transfer apparatus may also include a secondary heating device 53 including a radiant heater 52 and a divergent infra-red reflector 54. The divergent reflector 54 is adapted to disperse the infra-red radiation emitted by the radiant heater 52 towards the rubber layer 13 over a wide radius. The electrical power supply device 62 may be suited for supplying the heating device 53.

Figure 3:
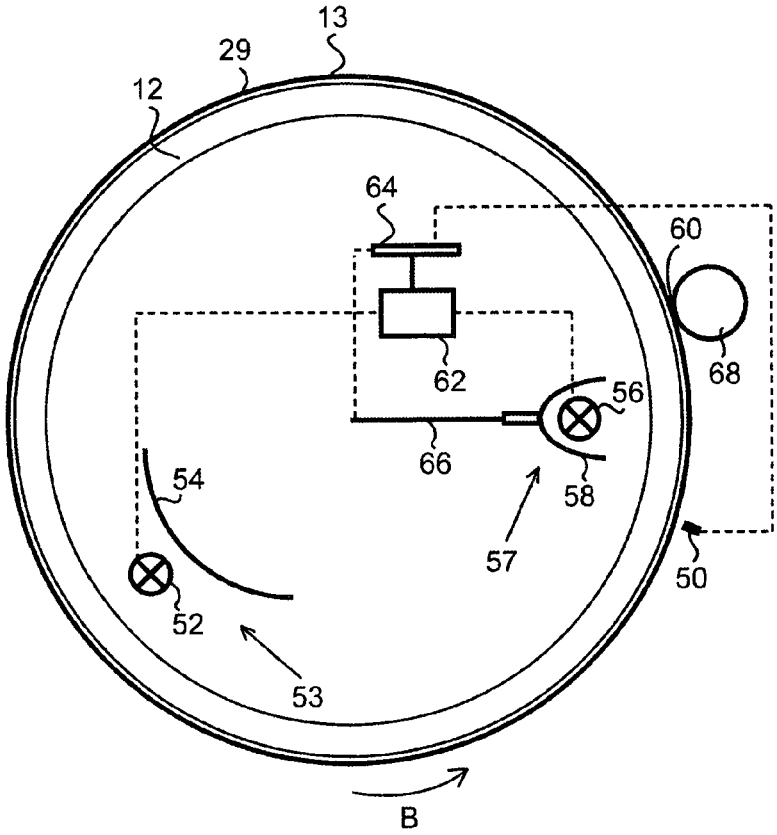
FIG. 3 diagrammatically illustrates a cross section of the transfer apparatus according to a first embodiment of the present invention.
Figure 4:
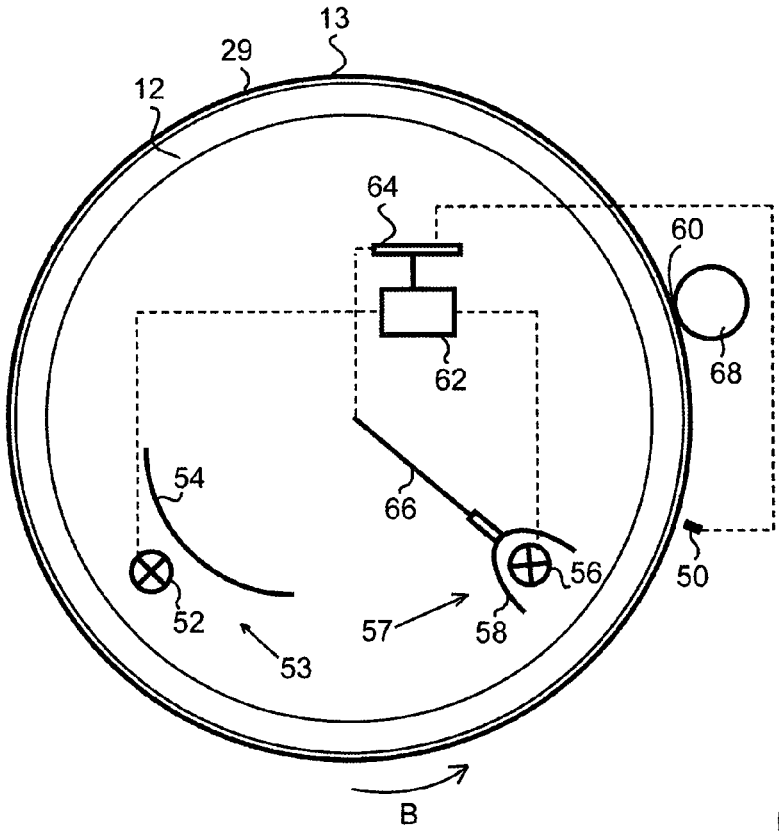
FIG. 4 diagrammatically illustrates the transfer apparatus according to the first embodiment of the present invention wherein the heating device is rotated.

In the example of FIG. 3, the displacing device 66 are a rotation device that is adapted to cause the heating device 57 to rotate around an axis perpendicular to the plane of the figure, i.e. parallel to the drum's axis. With the rotation device 66, the heating device 57 may be rotated from a first position, shown in FIG. 3, to a second a second position, shown in FIG. 4.

FIGS. 5A and 5B are cross sections showing in more detail the first and second positions, respectively. As is shown in cross section in FIG. 3 and FIG. 5A, when the heating device 57 is in the first position, the intersection between the optical axis 67 of the heating device 57 and the inner circumference of the rubber layer 13 defines an area F1. The area F1 is a focus segment located at the inner surface of the rubber layer 13 and being parallel to the axis of the drum 12. The first position is such that the convergent reflector 58 is adapted to focus the infra-red radiation generated by the radiant heater 56 towards the area F1. The first position corresponds to the normal position of the heating device 57, such as during a printing operation and when in a stand-by status. The second position of the heating device 57 is characterised by an angle $\alpha$ of the rotation. The angle $\alpha$ is the angle made between the optical axis 67 when the heating device 57 is in the first or normal position (FIG. 5A) and the optical axis 67 when the heating device 57 is in the second or calibration position (FIG. 5B).

When the heating device 57 is in the second position, the intersection between the optical axis 67 of the heating device 57 and the inner circumference of the rubber layer 13 defines an area F2. In the second position, the convergent reflector 58 is adapted to focus the infra-red radiation generated by the radiant heater 56 towards the area F2. The area F2 is located upstream from the sensor 50, when the rotation direction B of the drum 12 is considered. When a calibration procedure to be described hereinafter is carried out, the heating device 57 is brought at some moment of the procedure into the second or calibration position, defined by the angle $\alpha$.

The distance along the line corresponding to the cross section of the rubber layer 13 from the area F2 to the sensor 50 is approximately equal to the distance from the area F1 to the nip 60. Therefore, when the heating device 57 is in the second position while they are supplied at a power having a given value, the temperature measured by the sensor 50 is approximately equal to the temperature of the rubber layer in the nip 60 when the heating device 57 is in the first position while they are supplied at a power having the same given value. Compared to the circumference of the transfer drum 12, the focus area F2 and the sensor 50, the focus area F1 and the nip 60 are positioned closely to each other. The distance from the focus area F2 to the sensor 50 and the distance from the focus area F1 to the nip 60 are each approximately equal to 25 mm while the circumference of the drum 12 is about 935 mm, for example.

A calibration procedure (see hereinafter) makes it possible to establish a relationship between the temperature jump $\Delta T_J$ ($\Delta T_J = T_{NIP} - T_{BASIS}$) and the value of the power P supplied by the electrical supply device 62 to the heating device 57. Since the basis temperature $T_{BASIS}$ is measured at regular intervals during a printing operation, and the signal indicative of the measured temperature is transmitted to the controller 64, the power supplied by the electrical supply device 62 to the heating device 57 can be adjusted in a way that the temperature in the nip $T_{NIP}$ remains substantially constant during a printing operation, during the entire lifetime of the image-bearing medium 13. The quality of printing thus remains of high quality during the entire lifetime of an image-bearing medium.

Thanks to the facts that the heating device 57 is adapted to focus the heat towards two different areas in space (F1 and F2), a first temperature difference and a second temperature difference in the vicinity of the rubber layer 13 may be measured during a calibration procedure. The calibration procedure is now explained with reference to FIG. 6. Preferably, the calibration procedure is fully automated, the controller 64 being adapted to issue instructions to the different modules of the transfer apparatus for carrying out the steps of the calibration procedure. With a fully automated calibration procedure, the displacing device 66, which is controlled by the controller 64 may provoke a displacement of the heating device 57, when required. The controller 64 includes for example a processor, a first memory device such as a RAM whereon data may be written during the calibration procedure and a second memory device such as an EPROM for storing instructions executable by the processor.

A calibration procedure will now be described. In a first step S2, the calibration procedure is initiated, and from the start until the end of the procedure, the transfer drum 12 with the rubber layer 13 is rotated at a certain so-called "calibration" speed, which is preferably equal to the normal speed during a printing operation. In step S4, the power supply device 62 receives an instruction from the controller 64 to supply power having a first constant output value P1 (for example 1400 W) to the heating device 57. The power P1 is maintained constant while steps S6 and S8 are performed. In the present example, the secondary heating device 53 is not driven. The aim of steps S6 and S8 is to measure a first temperature difference. In step S6, while the heating device 57 is in the first position, which corresponds to the situation depicted in FIG. 3 and FIG. 5A, a temperature $T1_{BASIS}$ is measured by the temperature sensor 50 and is transmitted to the controller 64, where it is stored on a dedicated memory (for example, the RAM). In step S7, the controller issues an instruction to the displacing device 66 in order to rotate the heating device 57 to its second position, being represented in FIG. 4 and FIG. 5B. In step S8, while the heating device 57 is in the second position, a temperature $T1_{CAL}$ is measured by the temperature sensor 50 and is transmitted to the controller 64, where it is stored on a dedicated memory (for example, the RAM).

In step S10, a first temperature difference is calculated using the relationship $\Delta T1=T1_{CAL}-T1_{BASIS}$. For a better accuracy of the determination of the first temperature difference, optionally, steps S6, S7 and S8 may be repeated a number of times, in order to obtain a number of measured values for $T1_{CAL}$ and $T1_{BASIS}$ and thus an averaged first temperature difference $\Delta T1$.

Then, in step S12, the power supply device 62 receives an instruction from the controller 64 to supply power having a second output value P2 (for example 2200 W) to the heating device 57. The power P2 is maintained constant while steps S14 and S16 are performed. The aim of steps S14 and S16 is to measure a second temperature difference. In step S14, while the heating device 57 is in the first position (rotation may be needed, depending on the last position taken by the heating device 57), which corresponds to the situation depicted in FIG. 3 and FIG. 5A, a temperature $T2_{BASIS}$ is measured by the temperature sensor 50 and is transmitted to the controller 64, where it is stored on the RAM. In step S15, the controller issues an instruction to rotate the heating device to the second position, being the one represented in FIG. 4 and FIG. 5B. In step S16, while the heating device 57 is in the second position, a temperature $T2_{CAL}$ is measured by the temperature sensor 50 and is transmitted to the controller 64, where it is stored on the RAM.

In step S18, a second temperature difference is calculated by a processor on the controller 64 using the relationship $\Delta T2=T2_{CAL}-T2_{BASIS}$. For better accuracy of the determination of the second temperature difference, optionally, steps S14, S15 and S16 may be repeated a number of times, in order to obtain a number of measured values for $T2_{CAL}$ and $T2_{BASIS}$ and thus an averaged second temperature difference $\Delta T2$.

The temperature measured by the sensor 50 when the heating device 57 is in the second position ($T1_{CAL}$ or $T2_{CAL}$) is approximately equal to the temperature reigning in the nip 60 when the heating device 57 is in the first position, at a same value of the power supplied. Therefore, the differences $\Delta T1$ and $\Delta T2$ as determined previously substantially correspond to the temperature jump ($\Delta T_J=T_{NIP}-T_{BASIS}$), when the heating device is in the first (i.e. normal) position. Therefore, the relationship giving the temperature jump $\Delta T_J=T_{NIP}-T_{BASIS}$ as a function of the power P supplied by the power supply device 64 to the heating device 57 can now be determined. In step S20, the variation of $\Delta T_J$ may be determined using a simple linear relationship such as illustrated graphically in FIG. 7, wherein the shown straight line connects the points having co-ordinates (P1; $\Delta T1$) and (P2; $\Delta T2$), as previously determined in steps S10 and S18, respectively. In step S22, the result of the calibration may be stored on the RAM of the controller 64 in the form of a look-up table 80, such as shown in FIG. 8. Alternatively, the value of the power P may be calculated dynamically by the processor on demand using a simple arithmetical operation based on the slope and the y-intercept of the straight line shown in FIG. 7.

The look-up table 80 is then used by the processor of the controller 64 for determining, during a printing operation, the power supply P to be output by the power supply device 64 to the heating device 57, for obtaining the targeted temperature $T_{NIP}$ (for example $T_{NIP}$=114 degrees Celsius) in the nip 60, in response to the signal received by the controller indicative of the basis temperature $T_{BASIS}$.

The result of the calibration, for example the graph shown in FIG. 7 or the look-up table 80, thus allows the determination of the required power P in order to obtain the targeted temperature in the nip 60. During a printing operation, the basis temperature $T_{BASIS}$ is measured at regular intervals by the sensor 50 and the signal indicative of the basis temperature $T_{BASIS}$ is transmitted to the controller. In order to achieve proper fusing, a certain constant target temperature $T_{NIP}$ (for example 114° C.) must be achieved in the nip 60. In response to the signal indicative of the basis temperature $T_{BASIS}$, the controller 64 determines the required temperature jump $\Delta T_J$ ($\Delta T_J=T_{NIP}-T_{BASIS}$) in order to achieve the targeted temperature $T_{NIP}$. Then, the controller 64 extracts from the look-up table 80 the adequate value for the power P to be supplied by the supply device 62 to the heating device 57 to obtain the determined temperature jump. Finally, the controller 64 issues an instruction to the power supply device 62 to supply the heating device 57 according to the determined power output value P.

During a printing operation, with a transfer apparatus according to the present invention, only one of both heating devices (in the example, the heating device 57) needs to be electrically supplied. The secondary heating device (in the example, the heating device 53) is only electrically supplied in a stand-by state, in order to maintain the image-bearing member at a certain stand-by state temperature. Compared to the transfer apparatus of the background art (see FIG. 2) wherein both heating devices were electrically supplied during a printing process, the transfer apparatus according to the present invention is, from an energetic point of view, more efficient. Indeed, during a printing process, only the heating device 57 needs to be supplied, thanks to the calibration performed according to the method of the present invention. Therefore, a significant temperature decoupling between the print functions and the transfer functions of the printing apparatus can be achieved. This has the benefit that less cooling is required during a printing operation, since the heating is only carried out in the areas where it is required, i.e. in the vicinity of the fuse nip. The print functions (i.e. the locations of the image-forming elements 16) are heated less than with the known embodiment during a printing operation, and consequently need less cooling. Compared to the known apparatus, the transfer apparatus according to the present invention achieves that a given temperature in the transfer nip is obtained with less energy supply. In other words, the energy balance is more favorable with the transfer apparatus according to the present invention. Moreover, the temperature in the nip can be controlled more precisely, because the calibration procedure can be performed again after a certain number of print cycles has been reached.

Figure 9:
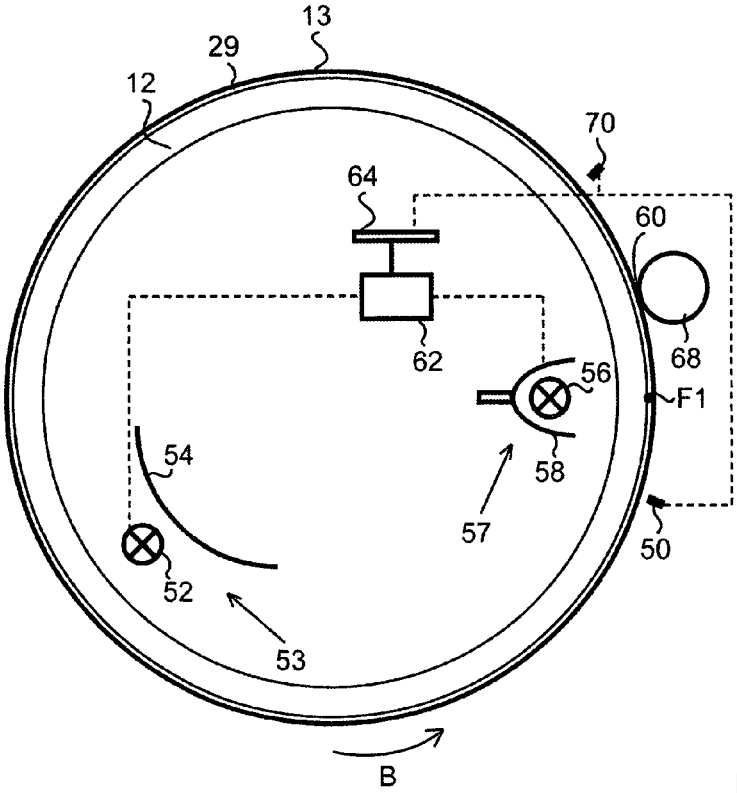
FIG. 9 diagrammatically illustrates a cross section of the transfer apparatus according to a second embodiment of the present invention.
Figure 10:
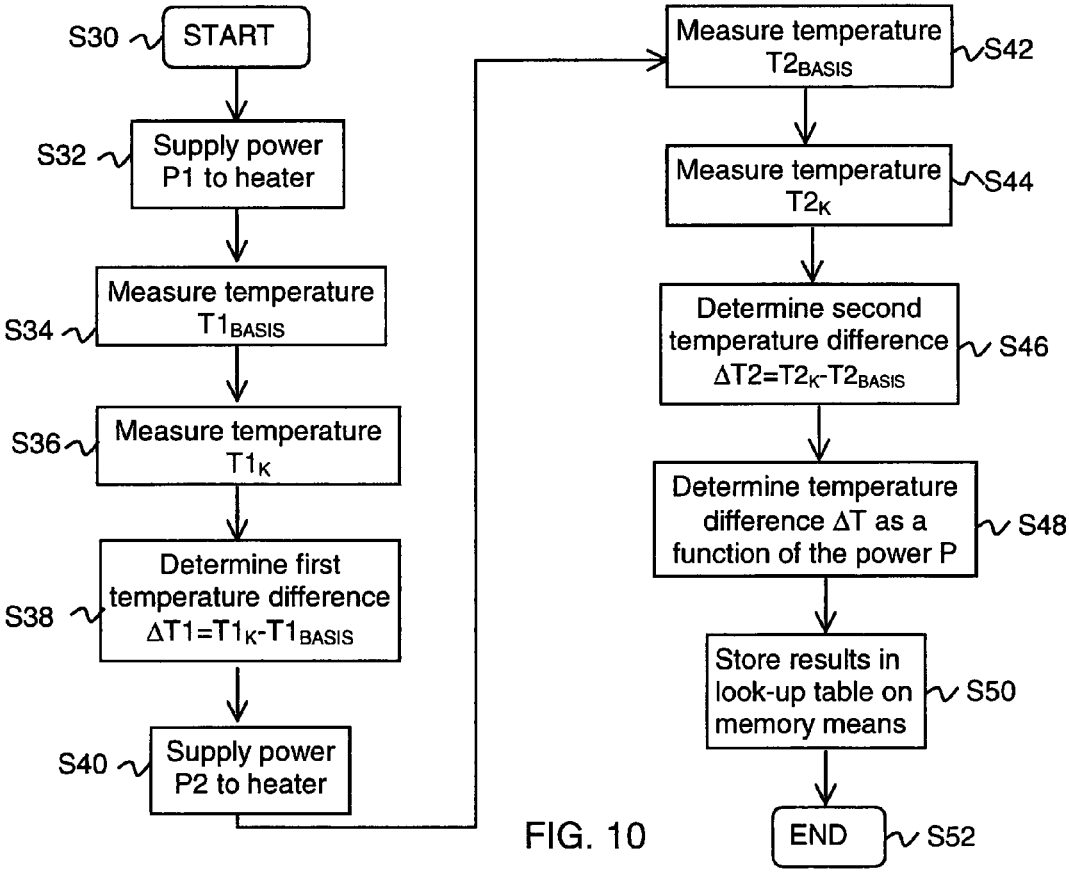
FIG. 10 is a flow-chart diagram illustrating the calibration method according to a second embodiment of the present invention.

The transfer apparatus according to a second embodiment of the present invention is represented schematically in FIG. 9 and is explained in conjunction with the flow-chart of FIG. 10, representing the method according to a second embodiment of the present invention. The transfer apparatus shown in cross section in FIG. 9 includes a pressure roll 68 for pressing the image-bearing medium 13 against the image receiving medium in a transfer zone 60, a heating device 57, an electrical power supply device 62 that supplies the heating device 57, a controller 64 that controls the electrical power supply device 62, a first temperature sensor 50 and a second temperature sensor 70 that measure a temperature in a vicinity of the image-bearing medium 13, the sensors 50 and 70 being located at two distinct locations in space and being each suited for sending a temperature signal to the controller 64. The temperature sensor 50 is, like in the first embodiment, suited for measuring a basis temperature. It is located upstream from the focus area F1 associated to the heating device 57, the area F1 being itself located upstream from the nip 60. The second temperature sensor 70 is located downstream from the nip 60. The temperature sensors 50 and 70 are placed such that each of the measured temperatures is approximately equal to the temperature of the outer surface of the rubber layer 13. Compared to the circumference of the transfer drum 12 (about 935 mm) the focus area F1, the nip 60 and the second temperature sensor 70 are located close to each other. The distance between the area F1 and the nip 60, and the distance between the nip 60 and the sensor 70 are approximately the same in the present example (about 25 mm, for example). Alternately, the sensor 70 may be placed closer to the nip 60.

The transfer apparatus may also include a secondary heating device 53 that includes a radiant heater 52 and a divergent infra-red reflector 54. The electrical power supply device 62 may be suited for supplying the heating device 53.

With the temperature sensors 50 and 70, a first temperature difference and a second temperature difference of the rubber layer may be measured during a calibration procedure, initiated in step S30 (see FIG. 10). During the calibration procedure, the transfer drum 12 with the rubber layer 13 is rotated at a so-called "calibration speed," explained hereinafter. The controller 64 then issues in step S32 an instruction to the supply device 62 to supply power having the value P1, for example 1400 W, to the heating device 57. While power having a first value P1 is supplied to the heating device 57, a basis temperature $T1_{BASIS}$ is measured in step S34 by the temperature sensor 50 and a corresponding temperature signal is transmitted to the controller 64. Concurrently, a temperature $T1_K$ is measured in step S36 by the temperature sensor 70 and the corresponding temperature signal is transmitted to the controller 64. The measurements of $T1_{BASIS}$ and $T1_K$ are preferably repeated a large number of times, so that an averaged value can be obtained for each of the temperatures, which improves the reliability of the measurements. The values of $T1_{BASIS}$ and $T1_K$ are stored on the RAM of the controller 64. In step S38, a first temperature difference $\Delta T1$ ($\Delta T1 = T1_K - T1_{BASIS}$) is calculated by the controller 64.

In step S40, the controller 64 issues an instruction to the electrical supply device 62 to supply power having a first value P2 to the heating device 57, for example 2200W. While power P2 is supplied to the heating device 57, a basis temperature $T2_{BASIS}$ is measured in step S42 by the temperature sensor 50 and a corresponding temperature signal is transmitted to the controller 64. Concurrently, a temperature $T2_K$ is measured in step S44 by the temperature sensor 70 and the corresponding temperature signal is transmitted to the controller 64. Preferably, an averaged value is obtained for each of the temperatures, which improves the reliability of the measurements. The values of $T2_{BASIS}$ and $T2_K$ are stored on the RAM of the controller 64.

A second temperature difference $\Delta T2$ ($\Delta T2 = T2_K - T2_{BASIS}$) is calculated in step S46 by the controller 64. A relationship between the power P supplied by the supply device 62 to the heating device 57 and the temperature difference $\Delta T$ ($\Delta T = T_K - T_{BASIS}$) can be established in step S48. The temperature difference $\Delta T$ is the predicted temperature difference, when the supply device furnishes a power P to the heating device 57, between a basis temperature $T_{BASIS}$ and a temperature $T_K$ in the vicinity of the rubber layer 13, at a short distance downstream from the nip 60. In order to establish the predicted temperature difference $\Delta T$ as a function of the power P, use is made of the measured temperature differences $\Delta T1$ and $\Delta T2$ and of the assumption that the relationship is linear. The relationship between $\Delta T$ and P obtained within the calibration procedure may be represented by a graph (similar to the one shown in FIG. 7) or a look-up table (similar to the one represented in FIG. 8). The calibration procedure is ended in step S52.

During a printing operation, the basis temperature $T_{BASIS}$ is measured at regular intervals by the sensor 50 and the signal indicative of the basis temperature $T_{BASIS}$ is transmitted to the controller. The look-up table is used by the processor of the controller 64 for determining, using a model, the power supply to be delivered by the power supply device 64 to the heating device 57, for obtaining the targeted temperature $T_{NIP}$ in the nip 60. The model is needed in order to establish the relationship between the targeted temperature jump $\Delta T_J$ ($\Delta T_J = T_{NIP} - T_{BASIS}$) and the predicted temperature difference $\Delta T$ ($\Delta T = T_K - T_{BASIS}$). The model may be based on the fact that the measured temperature $T_K$ is slightly less than the temperature in the nip 60. Expressed arithmetically, this gives rise to the following relationships: $T_K = T_{NIP} - D$, and consequently:

$\Delta T=\Delta T_J-D$, wherein D is a constant having a value known experimentally (for example D=2 degrees Celsius, when the "calibration" speed is equal to the normal speed).

As stated above, during the calibration procedure, while temperatures differences $\Delta T1$ and $\Delta T2$ are measured, the transfer drum is rotated at a "calibration speed." In the second embodiment of the method, the calibration speed may be larger than the normal printing speed, for example twice the normal printing speed. In this case, the temperature $T_{NIP}$ in the nip in normal conditions is the temperature $T_K$ measured by the sensor 70 after the nip 60, corrected by a certain proportionality factor. This is due to the fact that the calibration speed differs from the normal printing speed. Hence, the amount heat received by unity of surface of image-bearing surface depends on the rotation speed of the drum 12, which influences said proportionality factor.

During a printing operation, the temperature sensor 50 transmits at regular intervals a signal to the controller 64 indicative of the basis temperature $T_{BASIS}$. In order to achieve proper fusing, a certain constant target temperature $T_{NIP}$ must be achieved in the nip 60. Based on the basis temperature $T_{BASIS}$, the controller 64 determines the required temperature jump $\Delta T_J$ ($\Delta T_J=T_{NIP}-T_{BASIS}$) in order to achieve the targeted temperature $T_{NIP}$. The controller then determines the required temperature difference $\Delta T$ by use of the relationship $\Delta T=\Delta T_J-D$, for example. Then, the controller extracts from the look-up table 80 the adequate value for the power P to be supplied by the supply device 62 to the heating device 57. Finally, the controller 62 issues an instruction to the power supply device 62 for supplying the heating device 57 according to the determined power output value P.

The transfer apparatus according to the present invention is also useful for detecting the end of life of a rubber layer 13. Indeed, the measured temperature difference during the calibration procedure, for example $\Delta T1$, depends on the thickness of the rubber layer. With an increasing number of print cycles, the rubber layer is getting thinner, due to wear. The measured temperature difference $\Delta T1$ is sensitive to the thickness of the rubber layer. When, during calibration, the measured temperature difference is above a certain threshold, this signifies the end of life of the rubber, and a signal may be given, indicating that replacement is required. Compared to the known apparatus, a longer lifetime of the rubber layer may be achieved, since the end of life is detected more precisely.

Figure 11:
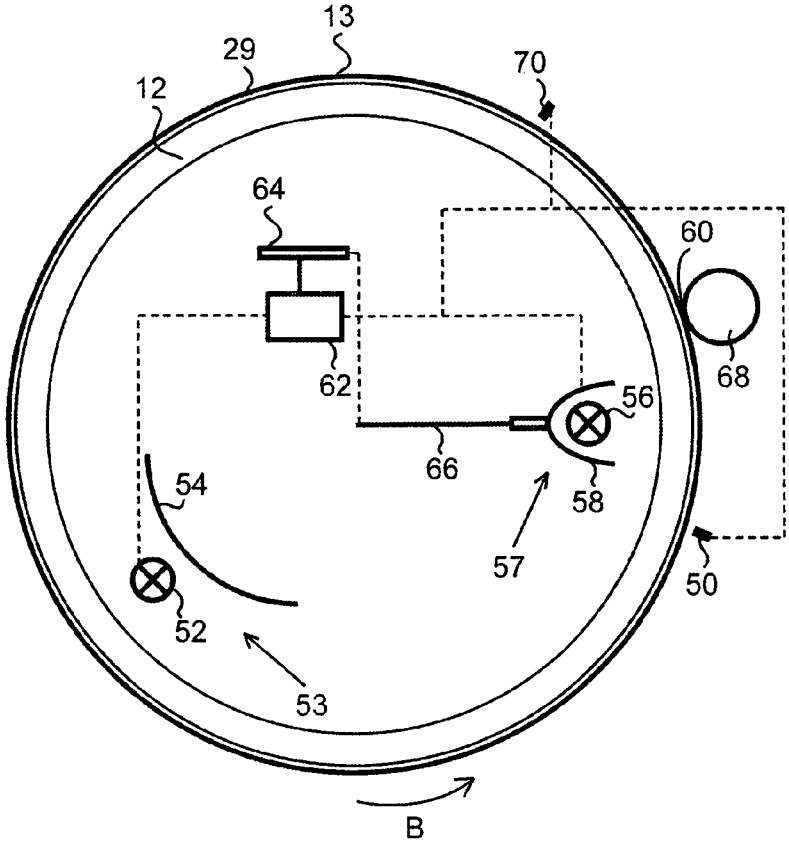
FIG. 11 diagrammatically illustrates a cross section of the transfer apparatus according to a third embodiment of the present invention.
Figure 12A:
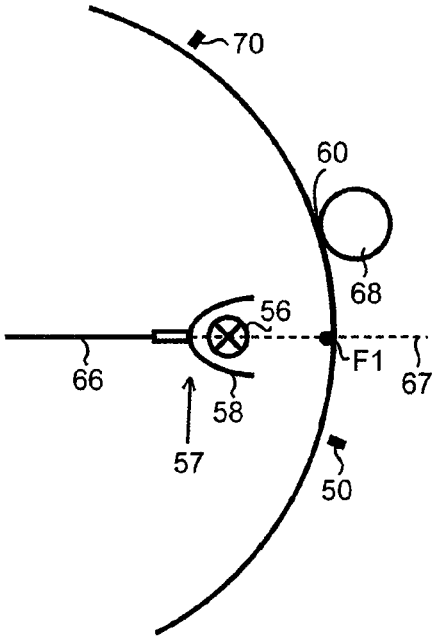
FIGS. 12A and 12B show, respectively, the heating device in a first and second position.
Figure 12B:
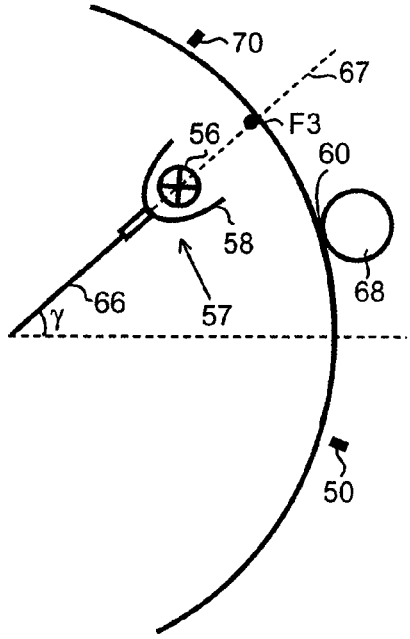
Figure 13:
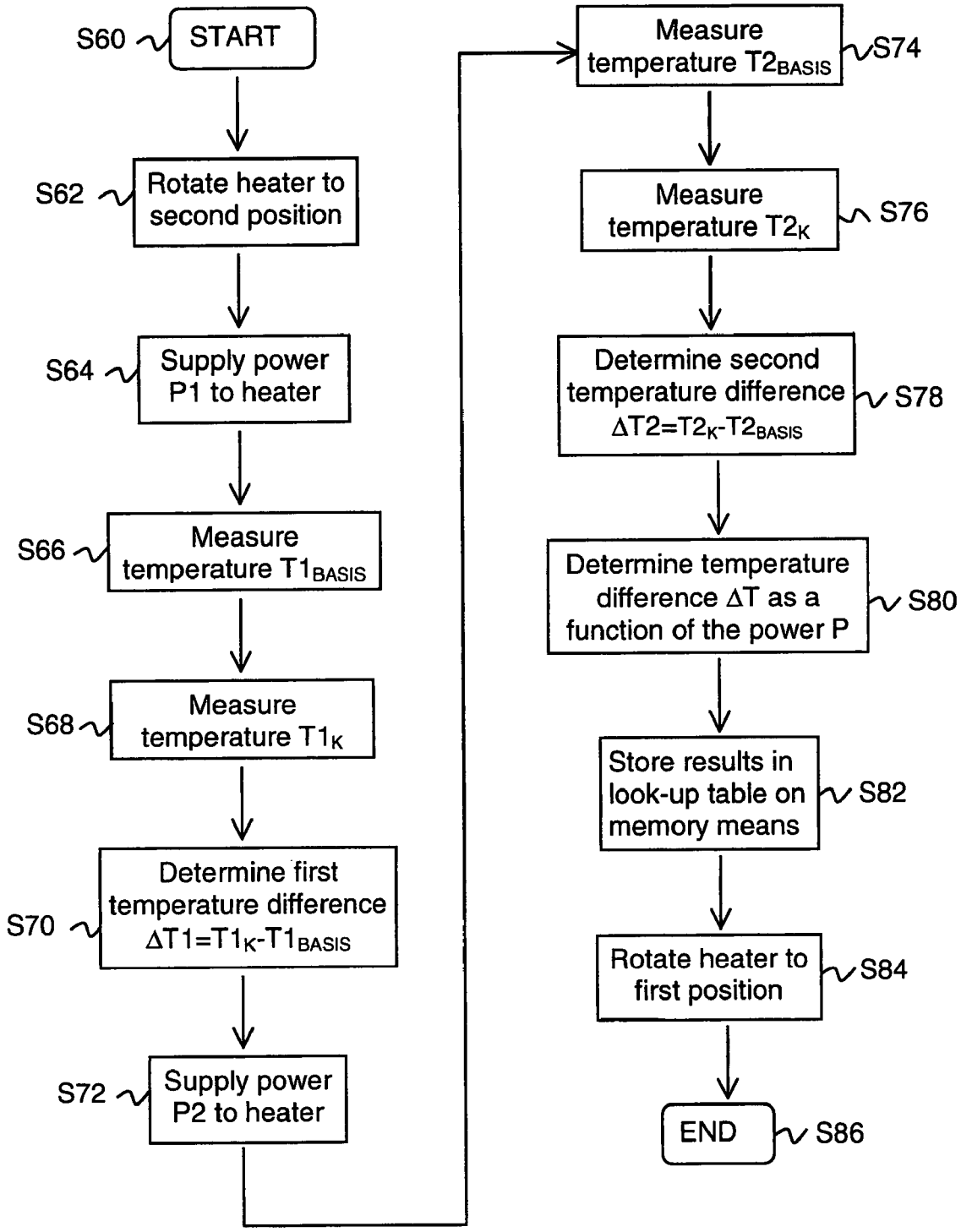
FIG. 13 is a flow-chart diagram illustrating the calibration method according to a third embodiment of the present invention.

The transfer apparatus according to a third embodiment of the present invention is represented schematically in FIGS. 11, 12A and 12B and is explained in conjunction with the flow-chart of FIG. 13, representing the method according to a third embodiment of the present invention.

In the third embodiment, shown in FIG. 11, the transfer apparatus includes a pressure roll 68 for pressing the image-bearing medium 13 against the image receiving medium in a transfer zone 60, a heating device 57 provided with a displacing device 66, an electrical power supply device 62 supplies electrically the heating device 57 and a controller 64 that controls the electrical power supply device 62. The displacing device 66 is suited for moving part of or all of the heating device 57 from a first position to a second position. The displacing device 66 may be controlled by the controller 64. The displacing device 66 is for example a rotation device adapted to cause the heating device 57 to rotate around an axis perpendicular to the plane of the figure and parallel to the drum axis. With such a rotation device 66, the heating device may be rotated from a first position, shown in FIG. 12A to a second a second position, shown in FIG. 12B. The transfer apparatus further includes a first temperature sensor 50 and a second temperature sensor 70, each suited for measuring a temperature in a vicinity of the image-bearing medium 13. The sensors 50 and 70 are located at two distinct locations in space and each of them is suited for transmitting a signal to the controller 64 indicative of the measured temperature. The temperature sensors 50 and 70 are placed such that each of the measured temperatures is approximately equal to the temperature of the outer surface of the rubber layer 13.

The transfer apparatus may also include a secondary heating device 53 that includes a radiant heater 52 and a divergent infra-red reflector 54. The electrical power supply device 62 may be suited for supplying the heating device 53.

FIGS. 12A and 12B show in detail the first and second positions taken by the heating device 57, respectively (cross section). When the heating device 57 is in the first position (normal position), the intersection between the optical axis 67 of the heating device 57 and the inner circumference of the rubber layer 13 defines an area F1. In the cross section shown in FIG. 12A, the area F1 corresponds to a fixed point in space located at the inner surface of the rubber layer 13. The second position of the heating device 57 is characterised by an angle $\gamma$ of the rotation. The angle $\gamma$ is the angle made between the optical axis 67 when the heating device 57 is in the first or normal position (FIG. 12A) and the optical axis 67 when the heating device 57 is in the second position (FIG. 12B). When the heating device 57 is in the second position (calibration position), the intersection between the optical axis 67 of the heating device 57 and the inner circumference of the rubber layer 13 defines an area F3. In the cross section shown in FIG. 12B, the area F3 corresponds to a fixed point in space located on the inner circumference of the rubber layer 13. The area F3 is located downstream from the nip 60, and upstream from the sensor 70, taking into consideration the rotation direction of the drum 12 represented by the arrow B. When a calibration procedure to be described hereinafter is carried out, the heating device 57 is brought to the second position, defined by the angle $\gamma$. The distance along the line corresponding to the rubber layer 13 between the area F3 and the sensor 70 is approximately equal to the distance between the area F1 and the nip 60. Therefore, when the heating device 57 is in the second position and is supplied at a power having a given value, the temperature measured by the temperature sensor 70 is approximately equal to the temperature of the rubber layer in the nip 60 when the heating device is in the first position and is supplied at a power having the same given value. The distance from the focus area F3 to the sensor 70 and the distance from the focus area F1 to the nip 60 are approximately equal to each other, the distance being for example about 25 mm.

The flowchart shown in FIG. 13 represents the calibration method according to a third embodiment of the present invention, which is executable in conjunction with the transfer apparatus shown in FIGS. 11, 12A and 12B. With the temperature sensors 50 and 70, a first temperature difference and a second temperature difference on the rubber layer may be measured during a calibration procedure, initiated in step S60. In step S62, the heating device 57 is rotated from the first or normal position (FIG. 12A) to the second or calibration position (FIG. 12B). In step S62, the controller 64 issues an instruction to rotate the heating device 57 into its second position. During the calibration procedure, the transfer drum 12 with the rubber layer 13 is rotated at a so-called "calibration speed," being preferably equal to the printing speed, i.e. the speed under normal printing conditions. The controller 64 then issues, in step S64, an instruction to the supply device 62 to supply power having the value P1, for example 1400 W, to the heating device 57. While power having a first value P1 is supplied to the heating device 57, a basis temperature $T1_{BASIS}$ is measured in step S66 by the temperature sensor 50 and a corresponding temperature signal is transmitted to the controller 64. Concurrently, a temperature $T1_K$ is measured in step S68 by the temperature sensor 70 and the corresponding temperature signal is transmitted to the controller 64. The measurements of $T1_{BASIS}$ and $T1_K$ are preferably repeated a large umber of times, so that an averaged value can be obtained for each of the temperatures, which improves the reliability of the measurements. The values of $T1_{BASIS}$ and $T1_K$ are stored on the RAM of the controller 64. In step S70, a first temperature difference $\Delta T1$ ($\Delta T1=T1_K-T1_{BASIS}$) is calculated by the controller 64.

In step S72, the controller 64 issues an instruction to the electrical supply device 62 to supply power having a first value P2 to the heating device 57, for example 2200W. While power P2 is supplied to the heating device 57, a basis temperature $T2_{BASIS}$ is measured in step S74 by the temperature sensor 50 and a corresponding temperature signal is transmitted to the controller 64. Concurrently, a temperature $T2_K$ is measured in step S76 by the temperature sensor 70 and the corresponding temperature signal is transmitted to the controller 64. Preferably, an averaged value is obtained for each of the temperatures, which improves the reliability of the measurements. The values of $T2_{BASIS}$ and $T2_K$ are stored on the RAM of the controller 64.

A second temperature difference $\Delta T2$ ($\Delta T2=T2_K-T2_{BASIS}$) is calculated in step S78 by the controller 64. A relationship between the power P supplied by the supply device 62 to the heating device 57 and the temperature difference $\Delta T$ ($\Delta T=T_K-T_{BASIS}$) can be established in step S80. The temperature difference $\Delta T$ is the predicted temperature difference, when the supply device furnishes a power P to the heating device 57, between a temperature $T_K$ in the vicinity of the rubber layer 13 measured by the sensor 70 and a basis temperature $T_{BASIS}$ measured by the sensor 50, with the heating device 57 in the second position. In order to establish the predicted temperature difference $\Delta T$ as a function of the power P, use is made of the measured temperature differences $\Delta T1$ and $\Delta T2$ and of the assumption that the relationship is linear. The relationship between $\Delta T$ and P obtained within the calibration procedure may be represented by a graph (similar to the one shown in FIG. 7) or a look-up table (similar to the one represented in FIG. 8). The heating device 57 is rotated back to its first position is step S84, being the normal position. The calibration procedure is ended in step S86.

The temperature measured by the sensor 70, when the heating device 57 is in the second position ($T1_K$ or $T2_K$) and are supplied at a power having a given value, is approximately equal to the temperature reigning in the nip 60 when the heating device 57 is in the first position and are supplied at a power having the same given value. Therefore, $\Delta T$ as determined previously substantially corresponds to the temperature jump ($\Delta T_J=T_{NIP}-T_{BASIS}$), when the heating device is in the first (i.e. normal) position. Therefore, the temperature jump $\Delta T_J=T_{NIP}-T_{BASIS}$ as a function of the power P supplied by the power supply device 64 to the heater 57 is approximately equal to $\Delta T$ ($\Delta T=T_K-T_{BASIS}$) as a function of P as determined by the calibration procedure. In printing operation, $T_{BASIS}$ is measured at regular intervals by the sensor 50 and a signal indicative of the measured basis temperature is transmitted to the controller. The controller, based on the value of the target temperature in the transfer zone and on the value of $T_{BASIS}$, determines the targeted temperature difference. The look-up table allows the determination of the adequate power value P to be supplied to the heating device 57 in order to obtain the determined targeted temperature difference and thus the target temperature in the transfer zone.

Compared to the first embodiment of the transfer apparatus according to the present invention, the third embodiment has the advantage that only one rotation of the heating device 57 is required during the calibration procedure. Indeed, with the third embodiment, once the heating device 57 is rotated, temperature differences may be measured concurrently by both sensors 50 and 70. Compared to the second embodiment of the transfer apparatus according to the present invention, the third embodiment has the advantage of a more precise determination of the temperature difference between the temperature in the nip and the basis temperature, since no correction is needed to determine the difference.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transfer apparatus for transferring an image of a developer from an intermediate image-bearing medium onto an image receiving medium, comprising:

a pressure member that presses the image receiving medium against the image-bearing medium in a transfer zone;

a heating device that heats the image-bearing medium;

a power supply device that supplies an adjustable electrical power to the heating device;

a first temperature sensor that senses a basis temperature in the vicinity of the image-bearing medium away from the transfer zone and for transmitting to a controller a signal indicative of the basis temperature, wherein said controller is adapted to compute a target temperature difference, said target temperature difference being a difference between a target temperature in the transfer zone and the basis temperature, based on the signal indicative of the sensed basis temperature and the knowledge of the target temperature, said controller being adapted to adjust the electrical power supplied by the power supply device to the heating device to obtain the target temperature in the transfer zone, based on the computed target temperature difference and the result obtained from a calibration procedure that establishes the dependence of the temperature difference between a temperature in the transfer zone and the basis temperature as a function of the supplied electrical power based on temperature readings taken when the heating device is in a first position and a second, different, calibration, position.

2. The transfer apparatus according to claim 1, wherein the heating device is provided with a displacing device that moves the heating device from a first position to a second position, whereby the first and second positions are configured for establishing the dependence of the temperature difference between a temperature in the transfer zone and the basis temperature as a function of the supplied electrical power.

3. The transfer apparatus according to claim 2, wherein the displacing device is a rotation device that is adapted to rotate the heating device around the axis of a cylindrical transfer drum that carries the image-bearing medium on an outer surface thereof.

4. The transfer apparatus according to claim 2, wherein the first position is the position of the heating device during a printing operation.

5. The transfer apparatus according to claim 3, wherein the first position is the position of the heating device during a printing operation.

6. The transfer apparatus according to claim 4, wherein the heating device is arranged in the first position for focussing the generated heat towards a first focus area on the image-bearing medium and in the second position for focussing the generated heat towards a second focus area on the image-bearing medium, the distance along a cross section line of image-bearing medium from the first focus area to the transfer zone being approximately equal to the distance from the second focus area to the temperature sensor.

7. The transfer apparatus according to claim 5, wherein the heating device is arranged in the first position for focussing the generated heat towards a first focus area on the image-bearing medium and in the second position for focussing the generated heat towards second focus area on the image-bearing medium, the distance along a cross section line of image-bearing medium from the first focus area to the transfer zone being approximately equal to the distance from the second focus area to the temperature sensor.

8. The transfer apparatus according to claim 1, wherein a second temperature sensor is provided for sensing an auxiliary temperature in the vicinity of the image-bearing medium away from the transfer zone and for transmitting to the controller a signal indicative of the auxiliary temperature, whereby the signal indicative of the basis temperature and the signal indicative of the auxiliary temperature are adapted for establishing the dependence of the temperature difference between a temperature in the transfer zone and the basis temperature as a function of the supplied electrical power.

9. The transfer apparatus according to claim 8, wherein the heating device is provided with a displacing device that moves the heating device from a first position to a second position, whereby the first position is the position of the heating device during a printing operation, and the second position of the heating device is configured for determining the temperature difference between a temperature in the transfer zone and the basis temperature as being equal to the difference between the sensed auxiliary temperature and the sensed basis temperature.

10. A method for calibrating a heating system of a transfer apparatus for transferring an image of a developer from an image-bearing medium onto an image receiving medium in a transfer zone, the heating system comprising a heating device that heats the image-bearing medium and an adjustable power supply device that supplies electrical power to the heating device, said method comprising the steps of:

supplying power to the heating device according to a first power value;

determining a first temperature difference between a temperature of the image-bearing medium in the transfer zone and a temperature of the image-bearing medium away from the transfer zone at said first power value;

supplying electrical power to the heating device according to a second power value;

determining a second temperature difference between a temperature of the image-bearing medium in the transfer zone and a temperature of the image-bearing medium away from the transfer zone at said second power value; and establishing a dependence of a temperature difference between a temperature in the transfer zone and a temperature of the image-bearing medium away from the transfer zone as a function of the power supplied to the heating device.

11. The method for calibrating a heating system according to claim 10, wherein the heating device is provided with a displacing device that moves the heating device from a first position to a second position, whereby a temperature of the image-bearing medium is measurable at a fixed position in space away from the transfer zone, said method further comprising the steps of:

measuring a first temperature with the heating device in the first position at said first power value;

measuring a second temperature with the heating device in the second position at said first power value;

determining the first temperature difference based on the first and second temperatures;

measuring a third temperature with the heating device in the first position at said second power value;

measuring a fourth temperature with the heating device in the second position at said second power value; and determining the second temperature difference based on the third and fourth temperatures.

12. The method for calibrating a heating system according to claim 10, wherein a basis temperature of the image-bearing medium is measurable at a fixed position in space away from the transfer zone, an auxiliary temperature of the image-bearing medium is measurable at another fixed position in space away from the transfer zone, said method further comprising the steps of:

measuring a first basis temperature at the first power value;

measuring a first auxiliary temperature at the first power value;

determining the first temperature difference based on the first basis temperature and on the first auxiliary temperature;

measuring a second basis temperature at the second power value;

measuring a second auxiliary temperature at the second power value; and determining the second temperature difference based on the second basis temperature and on the second auxiliary temperature.

13. The method for calibrating a heating system according to claim 10, wherein a basis temperature of the image-bearing medium is measurable at a fixed position in space away from the transfer zone, an auxiliary temperature of the image-bearing medium is measurable at another fixed position in space away from the transfer zone, the heating device is provided with a displacing device that moves the heating device from a normal position to a calibration position, said method further comprising the steps of:

moving the heating device from the normal position to the calibration position;

measuring a first basis temperature at the first power value;

measuring a first auxiliary temperature at the first power value;

determining the first temperature difference as being equal to the difference between the measured first auxiliary temperature and the measured first basis temperature;

measuring a second basis temperature at the second power value;

measuring a second auxiliary temperature at the second power value; and determining the second temperature difference as being equal to the difference between the measured second auxiliary temperature and the measured second basis temperature.

14. A printing apparatus comprising a transfer apparatus according to claim 1.

15. The transfer apparatus of claim 1, wherein the heating device includes means for focusing the generated heat towards a focus area on the image bearing medium, and the first temperature sensor is positioned upstream of the focus area of the heating device.

16. The method for calibrating a heating system of a transfer apparatus of claim 10, wherein the heating device focuses heat onto a focus area on the image bearing device.

17. The transfer apparatus of claim 2, wherein the first and second positions are located inside of a cylindrical image transfer drum that carries the image-bearing medium on an outer surface thereof.

18. The transfer device of claim 3, wherein the displacing device is adapted to rotate the heating device inside of the cylindrical transfer drum.

19. A transfer apparatus for transferring an image of a developer from an intermediate image-bearing medium onto an image receiving medium, comprising:

a pressure member that presses the image receiving medium against the image-bearing medium in a transfer zone;

a heating device that heats the image-bearing medium;

a power supply device that supplies an adjustable electrical power to the heating device;

a first temperature sensor that senses a basis temperature in the vicinity of the image-bearing medium away from the transfer zone and for transmitting to a controller a signal indicative of the basis temperature, wherein the heating device includes means for focusing the generated heat towards a focus area on the image bearing medium, and the first temperature sensor is positioned upstream of the focus area of the heating device, and wherein said controller is adapted to compute a target temperature difference, said target temperature difference being a difference between a target temperature of the intermediate image bearing member in the transfer zone and the basis temperature, based on the signal indicative of the sensed basis temperature and the knowledge of the target temperature, said controller being adapted to adjust the electrical power supplied by the power supply device to the heating device to obtain the target temperature in the transfer zone, based on the computed target temperature difference and the result obtained from a calibration procedure that establishes the dependence of the temperature difference between a temperature in the transfer zone and the basis temperature as a function of the supplied electrical power.

20. The transfer apparatus of claim 1, wherein the target temperature in the transfer zone is greater than the basis temperature and represents a jump in temperature from the basis temperature to the target temperature in the transfer zone.

21. The transfer apparatus of claim 20, wherein the calibration procedure is used to establish a relationship between the temperature jump and the value of power supplied to the heating device.

* * * * *